US005593319A

United States Patent [19]

Ohno

[11] Patent Number: 5,593,319

[45] Date of Patent: Jan. 14, 1997

[54] CONNECTOR MEMBER COMPRISING A CASING HAVING A COUNTERPART MEMBER RECEIVING SPACE LINED WITH A WATER-TIGHT SEALING MEMBER

[75] Inventor: Akira Ohno, Tokyo, Japan

[73] Assignee: Japan Aviation Electronics Industry, Limited, Tokyo, Japan

[21] Appl. No.: 338,253

[22] Filed: Nov. 14, 1994

[30] Foreign Application Priority Data

Mar. 18, 1994 [JP] Japan ..... 6-048569

[51] Int. Cl.[6] ..... H01R 13/40

[52] U.S. Cl. ..... 439/587

[58] Field of Search ..... 439/279, 281, 439/76.1, 587

[56] References Cited

U.S. PATENT DOCUMENTS 4,684,190 8/1987 Clark et al. ..... 439/587 OR
4,711,509 12/1987 Cross et al. ..... 439/587 OR
5,145,410 9/1992 Maejima et al. ..... 439/279 X
5,265,322 11/1993 Fisher et al. ..... 439/76.1 X
5,370,556 12/1994 Olsson ..... 439/677 X

*Primary Examiner*—P. Austin Bradley
*Assistant Examiner*—Daniel Wittels
*Attorney, Agent, or Firm*—Laff, Whitesel, Conte & Saret, Ltd.

[57] ABSTRACT

In a connector member comprising an insulator body with a plurality of contacts, a casing has an inside surface defining an opening as a counterpart member receiving space for receiving a counterpart member. To provide water-tight seal between the opening and the connector member, the casing is formed with four connector portions. The opening has a surrounding sealing inside surface lined with a sealing member, with the counterpart member surrounded by a counterpart sealing ring which matches the sealing member.

10 Claims, 4 Drawing Sheets

CONNECTOR MEMBER COMPRISING A CASING HAVING A COUNTERPART MEMBER RECEIVING SPACE LINED WITH A WATER-TIGHT SEALING MEMBER

BACKGROUND OF THE INVENTION

This invention relates to a connector member which is for water-tight connection to a counterpart member.

In the manner which will later be described more in detail, a conventional connector member comprises a printed circuit board, a connector portion attached to the printed circuit board, a casing, and sealing means for providing water-tight seal between the connector portion and the casing. It should, however, be noted that the sealing means has a complicated structure. This renders the connector member unreliable, bulky, and expensive.

SUMMARY OF THE INVENTION

It is consequently an object of this invention to provide a connector member with a reliable water-tight structure.

It is another object of this invention to provide a connector member with a compact and inexpensive structure.

Other objects of this invention will become clear as the description proceeds.

According to this invention, there is provided a connector member for connection to a counterpart member, the connector member comprising an insulator body, a plurality of conductive contacts rigidly held by the insulator body, a casing having an inside surface defining an opening as a counterpart member receiving space for receiving the counterpart member, and a connector sealing member attached integrally to the inside surface for providing water-tight seal between the opening and the counterpart member when the counterpart member is received in the counterpart member receiving space.

DESCRIPTION OF THE PREFERRED EMBODIMENT

Figure 1:
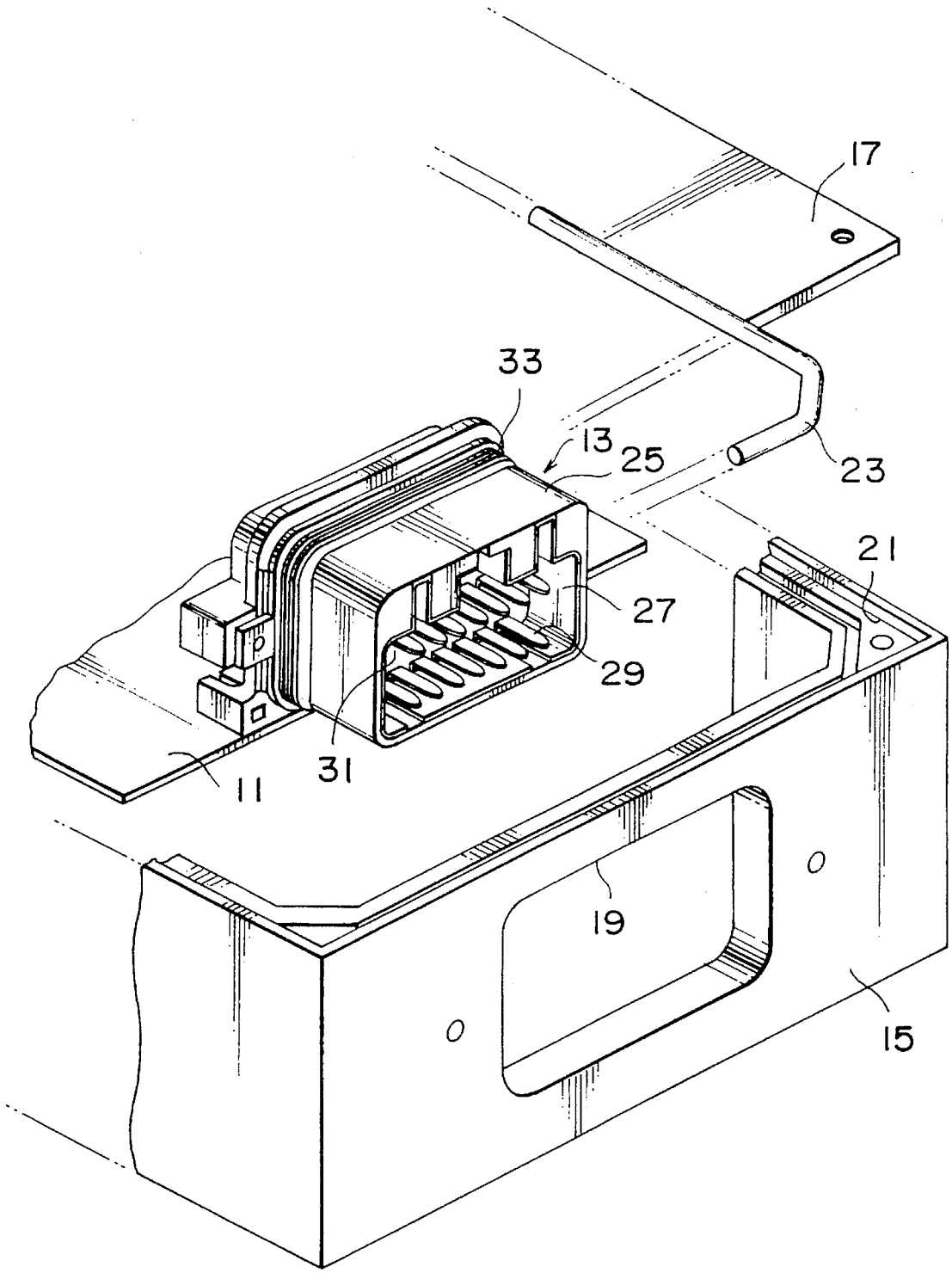
FIG. 1 PRIOR ART
FIG. 1 is an exploded partial perspective view of a conventional connector member.
Figure 2:
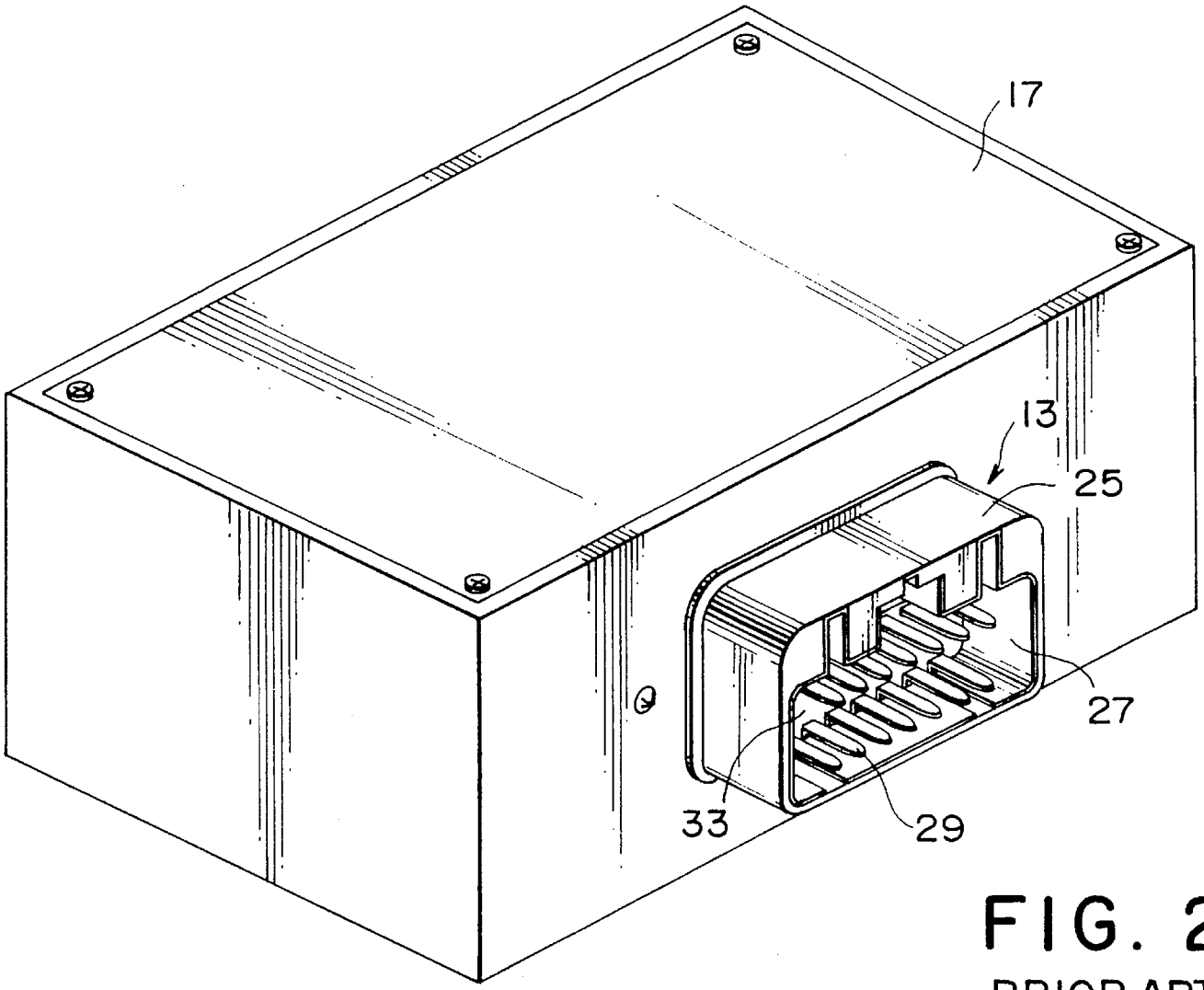
FIG. 2 PRIOR ART
FIG. 2 is a schematic perspective view illustrative of the conventional connector member of FIG. 1 in an assembled state.

Referring to FIGS. 1 and 2, a conventional connector member will first be described in order to facilitate an understanding of this invention.

The conventional connector member is connected to a counterpart member which is not depicted herein. The conventional connector member comprises a printed circuit board 11, a connector portion 13 comprising a front portion and a back portion and attached to the printed circuit board 11, a side casing 15 comprising a main wall having longitudinal ends and side walls perpendicularly extended from the longitudinal ends, and a lid 17 for covering the side casing 15. The main wall is formed with an approximately rectangular window 19 for receiving the connector portion 13.

The side casing 15 has a long narrow groove 21 formed along a top edge of the main and the side walls to receive a seal wire member 23. The lid 17 covers the side casing 15 with the seal wire member 23 interposed.

The connector portion 13 comprises an insulator body 25 having a thick wall depicted topwardly of the figure and three walls integral in the thick wall to define a receiving space 27 for receiving the counterpart member. A plurality of contacts 29 are rigidly held by a seal plate 31. The seal plate 31 seals the back portion of the connector portion 13 and is brought into a water-tight seal with an end surface of the counterpart member when the counterpart member is received in the receiving space 27. The insulator body 25 is enclosed with a seal ring 33 around the back portion. Together with the seal plate 31, the seal ring 33 provides water-tight seal between the back portion and the window 19 of the side casing 15.

On assembling the printed circuit board 11 with the connector portion 13, the side casing 15, and the lid 17 together, the seal wire member 23 is inserted in the long narrow groove 21 of the side casing 15. After the connector portion 13 is received in the rectangular window 19, the lid 17 is put on the top edge of the side casing 15 to cover the seal wire member 23.

In the connector member being illustrated, sealing means comprises the seal wire member 23, the seal plate 31, and the seal ring 33. The sealing means has a complicated structure. This renders the connector member unreliable, bulky, and expensive.

Figure 3:
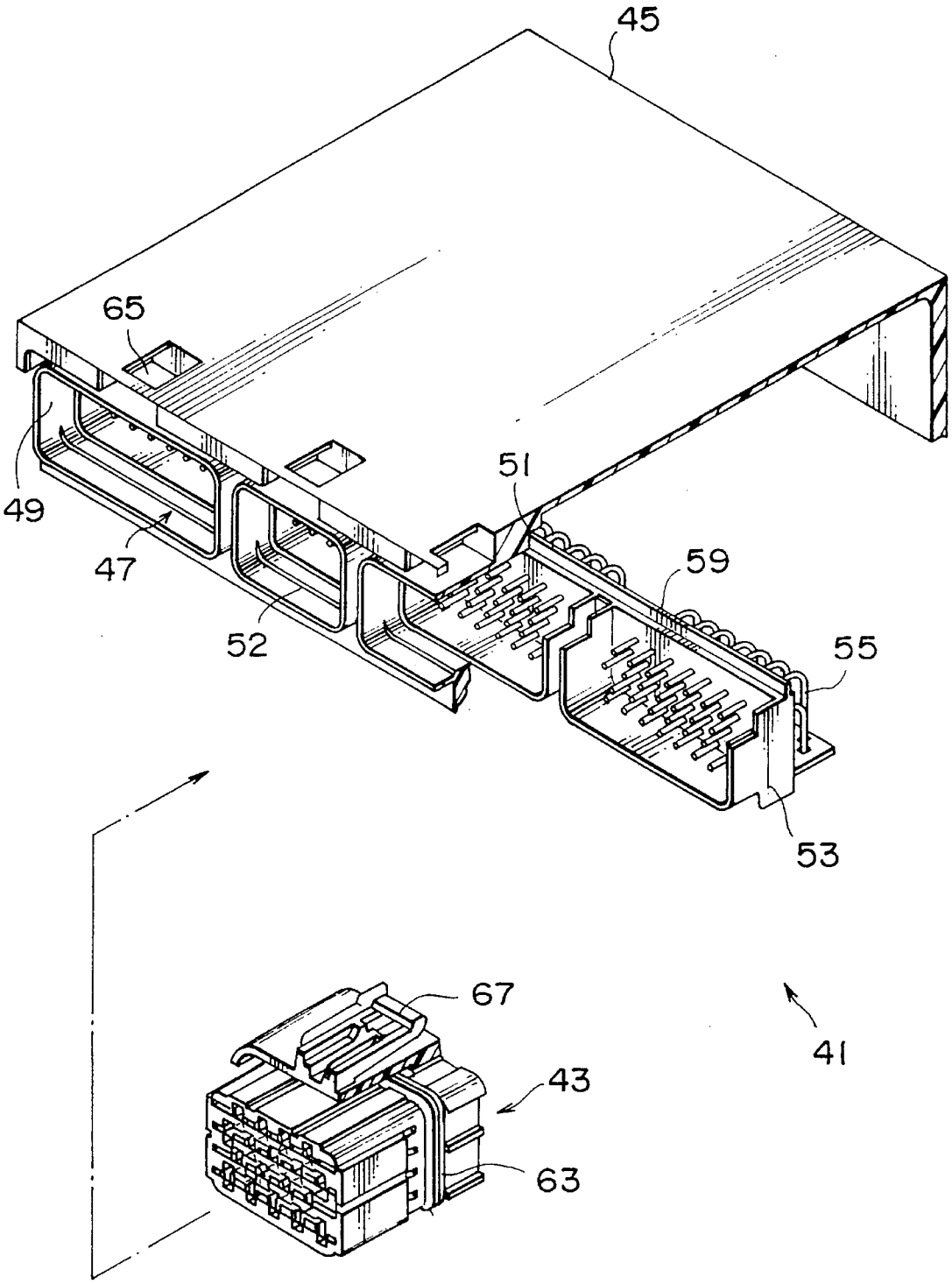
FIG. 3 is a schematic perspective view of a connector member according to an embodiment of this invention and of a counterpart member for connection to the connector member.
Figure 4:
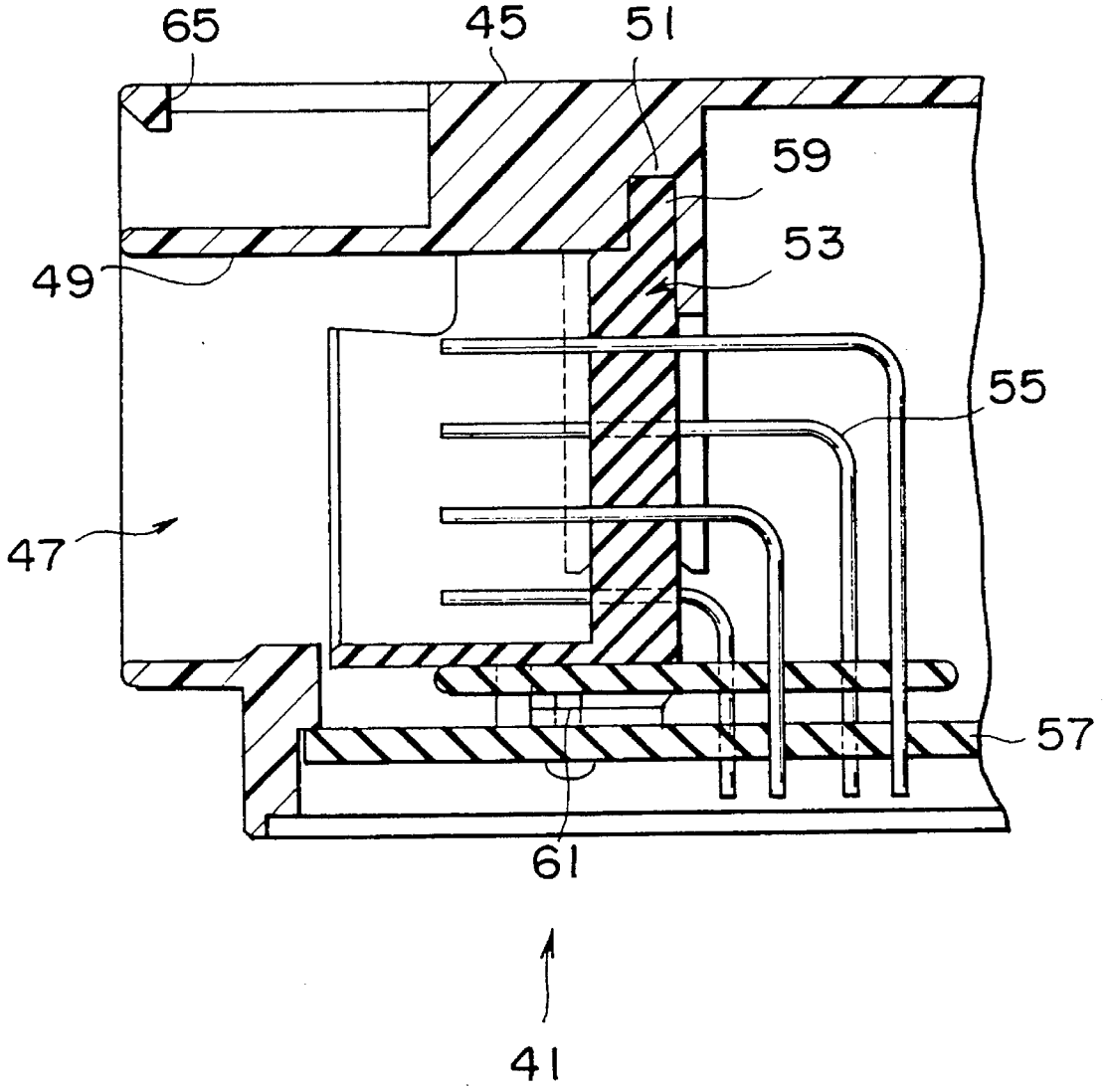
FIG. 4 is a schematic partial vertical sectional view of the connector member depicted in FIG. 3.

Referring now to FIGS. 3 and 4, the description will proceed to a connector member 41 according to a preferred embodiment of this invention.

For connection to the counterpart member 43, the connector member 41 comprises a casing 45 made of plastics. The casing 45 has a front side with four connectors holders, a back wall in parallel with the front side, and a cover wall extending from the front side to the back wall. In the manner illustrated in the figures, the four connectors holders of the casing 45 comprise four openings 47 for receiving the counterpart member 43 and has a partially bottomless structure so that an insulator body 53 can be put in place from a bottom side of the casing 45. It is possible to insert the counterpart member 43 into any one of the four openings 47 provided that the counterpart member 43 is smaller in width than one of the four openings 47 that is under consideration.

Each opening 47 has a surrounding inside surface 49 defining a counterpart member receiving space for receiving the counterpart member 41. Such inside surfaces 49 of the four openings 47 are open at their rear sides opposite to front ends of the front sides. Each inside surface 49 has a top surface, a pair of side surfaces contiguous to the top surface, and a bottom surface between bottom edges of the side surfaces.

In the manner best shown in FIG. 4, the side surfaces and the bottom surface have recessed parts recessed from the rear side. The cover wall has a key groove 51 on its bottom surface.

In FIG. 3, a connector sealing member 52 lines each inside surface 49, namely, is attached integrally to each inside surface 49. The sealing member 52 is attached to the bottom surface to extend at least partly to the side surfaces. The connector sealing member provides water-tight seal between the opening 47 and the counterpart member 41 received therein when the counterpart member 41 has a height and a width which match the opening 47 under consideration.

In FIGS. 3 and 4, the insulator body 53 comprises a back insulator wall and four connector portions which are forwardly extended from the back insulator wall and are brought into edge-to-edge abutment with walls of the four openings 47 in the manner which will presently be described. A plurality of conductive contacts 55 are rigidly held by the back insulator wall. The cover wall serves as a top lid of the four connector portions.

As best seen in FIG. 4, the insulator body 53 has a topless structure. More particularly, each of the four connector portions comprises a bottom insulator wall extended from the back insulator wall towards the front side to have a bottom wall front edge and a pair of side walls extended from the back wall integral with the bottom wall. The side walls have side wall front edges and recessed wall parts recessed from the side wall front edges.

In FIG. 4, a printed circuit board 57 is brought into water-tight contact with the insulator body 53 to define a sealed space in cooperation with the casing 45 as will shortly be described. The conductive contacts 55 extend as inward protuberances into the counterpart member receiving space through the back insulator wall. The conductive contacts 55 extend through the back insulator wall as outward protuberances substantially parallel with the casing 45 into the sealed space. The outward protuberances are bent in the sealed space so as to extend substantially perpendicular to the casing 45. The back insulator wall comprises a key portion 59 for reception in the key groove 51 to water-tight define the sealed space.

On assembling the connector member 41, the insulator body 53 is combined with the casing 45 by attaching the printed circuit board 57 to the insulator body 53 at a position depicted in FIG. 4 as follows. The bottom wall front edge, the side wall front edges, and the recessed wall parts of the insulator body 53 are brought into abutment with the recessed surface parts of the inside surface 49. The top surface of the inside surface 49 is brought into contact with the back insulator wall. The top surface of the inside surface 49 is used to cover top edges of the side walls of the insulator body 53. Meanwhile, the printed circuit board 57 is fastened by a screw 61 to the insulator body 53 with the key portion 59 received in the key groove 51. The printed circuit board 57 is urged at its front end to the casing 45.

When the printed circuit board 57 has no through-holes, this defines the sealed space. If the printed circuit board 57 has through-holes, a cover body (not shown) should additionally be attached to the casing 45 to cover the printed circuit board 57.

In FIG. 3, the counterpart member 43 comprises a connector part, a plurality of connecting pads rigidly held through a front wall of the connector part, and a counterpart sealing ring 63 for providing water-tight seal to the surrounding inside surface 49. The counterpart sealing ring 63 is pressed onto the surrounding inside surface 49 of the connector member 41 when the counterpart member 43 is received in the counterpart receiving space. A cable (not shown) is water-tight attached to the connecting pads.

The connector member 41 is formed with four indents 65 on the cover wall of the casing 45. In correspondence to the indents 65, the counterpart member 43 comprises a locking hook 67 around the connector part. When the counterpart member 43 is received in the connector member 41, the locking hook 67 is locked in one of the indents 65 with a click.

Reviewing FIGS. 3 and 4, the connector sealing member of one of the four openings 47 of the connector member 41 provides the seal between this one of the opening 47 and the counterpart member 43 when the counterpart member 43 is received in the counterpart member receiving space. It is possible to connect up to four counterpart members, such as 43, to the connector member 41 of the embodiment. If the counterpart members 43 are less in number than four, at least one dummy member with the counterpart sealing ring 63 is used to attain the water-tight seal.

While this invention has thus far been described in specific conjunction with a single preferred embodiment thereof, it will now be readily possible for one skilled in the art to put this invention into effect in various other manners. For example, the casing 45 may comprises only one connector holder for holding the counterpart member 43 which fits this connector holder. This renders the connector member 41 more compact and inexpensive.

What is claimed is:

1. A connector member for making a connection to a counterpart member, said connector member comprising an insulator body having peripheral side walls, a plurality of conductive contacts rigidly held by said insulator body, a casing having an inside surface defining an opening forming a complementary counterpart member receiving space for receiving said counterpart member, and said counterpart member comprising a peripheral counterpart sealing means for providing a water-tight seal together with a connector sealing member integrally attached to said inside surface of said opening for providing a water-tight seal between said peripheral side walls and said peripheral sealing means and said counterpart member when said counterpart member is received within said counterpart member receiving space.

2. A connector member claimed in claim 1, for connection to a counterpart member, said connector member comprising an insulator body, a plurality of conductive contacts rigidly held by said insulator body, a casing having an inside surface defining an opening as a counterpart member receiving space for receiving said counterpart member, a connector sealing member attached integrally to said inside surface for providing water-tight seal between said opening and said counterpart member when said counterpart member is received in said counterpart member receiving space, and a printed circuit board for defining a sealed space in cooperation with said insulator body and said casing, said conductive contacts extending in said sealed space and being connected to said printed circuit board.

3. A connector member as claimed in claim 2, said counterpart member comprising counterpart sealing means for providing said seal together with said connector sealing member when said counterpart member is received in said counterpart receiving space.

4. A connector member as claimed in claim 3, said connector member having a front side, wherein:

said inside surface is open at a rear side opposite to said front side and has a top surface, a pair of side surfaces contiguous to said top surface, and a bottom surface between bottom edges of said side surfaces, said side surfaces and said bottom surface having recessed surface parts recessed from said rear side with said connector sealing member attached to said bottom surface to extend at least partly to said side surfaces;

said insulator body comprising a back wall rigidly holding said conductive contacts, a bottom wall extended from said back wall towards said front side to have a bottom wall front edge, and a pair of side walls extended from said back wall integral with said bottom wall and having side wall front edges and recessed wall parts recessed from said side wall front edges;

said insulator body being combined with said casing with said bottom wall front edge, said side wall front edges, and said recessed wall parts brought into abutment with said recessed surface parts and with said top surface brought into contact with said back wall and used to cover top edges of said side walls when said printed circuit board defines said sealed space.

5. A connector member as claimed in claim 2, wherein said conductive contacts extend as inward protuberances into said counterpart member receiving space through said insulator body.

6. A connector member as claimed in claim 5, wherein said inward protuberances make contact with said counterpart member when said counterpart member is received in said counterpart receiving space.

7. A connector member as claimed in claim 2, wherein said conductive contacts extend as outward protuberances in substantially parallel with said casing into said sealed space through said insulator body.

8. A connector as claimed in claim 7, wherein said outward protuberances are bent in said sealed space so as to extend substantially perpendicular to said casing.

9. A connector member as claimed in claim 8, wherein said outward protuberances are connected to said printed circuit board.

10. A connector as claimed in claim 3, wherein said insulator body is formed with a key portion, said casing having an inner surface with a key groove for receiving said key portion.

* * * * *